US012693016B1

(12) United States Patent
Binek et al.

(10) Patent No.: US 12,693,016 B1
(45) Date of Patent: Jul. 28, 2026

(54) MESH BASED FUEL FLOW GUIDE

(71) Applicant: RTX Corporation, Farmington, CT (US)

(72) Inventors: Lawrence Binek, Glastonbury, CT (US); Frederick Rosenberger, West Hartford, CT (US); Timothy Snyder, Glastonbury, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/213,661

(22) Filed: May 20, 2025

(51) Int. Cl.
*F23R 3/10* (2006.01)
*F23R 3/28* (2006.01)

(52) U.S. Cl.
CPC ..... *F23R 3/10* (2013.01); *F23R 3/286* (2013.01)

(58) Field of Classification Search
CPC .... F23R 3/045; F23R 3/10; F23R 3/06; F23R 3/286; F23R 3/18; F23R 3/20; F23R 2900/03045
See application file for complete search history.

(56) References Cited

U.S. PATENT DOCUMENTS

| | | | | |
|---|---|---|---|---|
| 4,967,562 | A * | 11/1990 | Shekleton | F23R 3/28 60/738 |
| 5,277,022 | A * | 1/1994 | Shekleton | F23R 3/32 60/737 |
| 5,918,465 | A * | 7/1999 | Schmid | F23R 3/20 60/722 |
| 10,125,982 | B2 | 11/2018 | Graichen | |
| 10,781,696 | B2 | 9/2020 | Eriksson et al. | |
| 2022/0170636 | A1 * | 6/2022 | Binek | F23R 3/32 |

FOREIGN PATENT DOCUMENTS

| | | | | |
|---|---|---|---|---|
| FR | 3102794 | A1 * | 5/2021 | F23R 3/06 |
| WO | 2021217792 | A1 | 11/2021 | |

* cited by examiner

*Primary Examiner* — Andrew H Nguyen
(74) *Attorney, Agent, or Firm* — Kinney & Lange, P.A.

(57) ABSTRACT

A combustor system for an aerial vehicle includes an outer liner with a first end and a second end, an inner combustor case within the outer liner, defining an outer periphery of a central combustor chamber, and having a lumen extending into the central combustor chamber. The system includes an air flow path extending between the outer liner and the inner combustor case, an integrated air scoop which directs air from the air flow path into the central combustor chamber, a fuel manifold with a fuel orifice within the integrated air scoop, and a lattice splash plate with a first face, second face, first end, and a second end. The lattice splash plate extends through the first lumen into the central combustor chamber, and includes lattice holes which are graded into the lattice splash plate from the first end to the second end of the lattice splash plate.

16 Claims, 4 Drawing Sheets

MESH BASED FUEL FLOW GUIDE

BACKGROUND

A combustor section in a modern turbine engine includes one or more fuel injectors. Each fuel injector is operable to inject fuel for combustion within a combustion chamber. Air is mixed with fuel to facilitate combustion. Various types and configurations of fuel injectors and air flow paths are known in the art. While these known fuel injectors and air flow paths have various benefits, there is still room in the art for improvement. There is a need in the art, for example, for flow paths within a combustor to be improved.

SUMMARY

In one example, a combustor system for an aerial vehicle includes an outer liner with a first end and a second end, an inner combustor case within the outer liner, defining an outer periphery of a central combustor chamber, and having a lumen extending into the central combustor chamber. The system includes an air flow path extending between the outer liner and the inner combustor case, an integrated air scoop attached to the inner combustor case at the lumen which directs air from the air flow path into the central combustor chamber, a fuel manifold with a fuel orifice within the integrated air scoop, and a lattice splash plate with a first face, second face, first end, and a second end. The lattice splash plate extends through the first lumen into the central combustor chamber, and includes lattice holes which are graded into the lattice splash plate from the first end to the second end of the lattice splash plate.

In another example, a combustor system for an aerial vehicle includes an outer liner, the outer liner with a first end and a second end, an inner combustor case contained within the outer liner and defining an outer periphery of a central combustor chamber, lumens extending through the inner combustor case into the central combustor chamber, a first air flow path extending between and defined by the outer liner and the inner combustor case, and fluidly connected to the central combustor chamber by the lumens, integrated air scoops, each respective integrated air scoop attached to the inner combustor case at each respective lumen and configured to direct air from the first air flow path into the central combustor chamber, fuel manifolds with a fuel orifice within each respective integrated air scoop, and lattice splash plates comprising a first face and a second face, each respective splash plate extending through each respective lumen into the central combustor chamber, wherein lattice holes are graded into the respective lattice splash plate from the first end of the respective lattice splash plate to the second end of the respective lattice splash plate.

DETAILED DESCRIPTION

This disclosure presents a combustor system for a gas turbine engine. In particular, this disclosure involves directing a fluid containing oxygen into a central combustor chamber via an airflow path that includes air scoops and mesh lattice splash plates.

Figure 1:
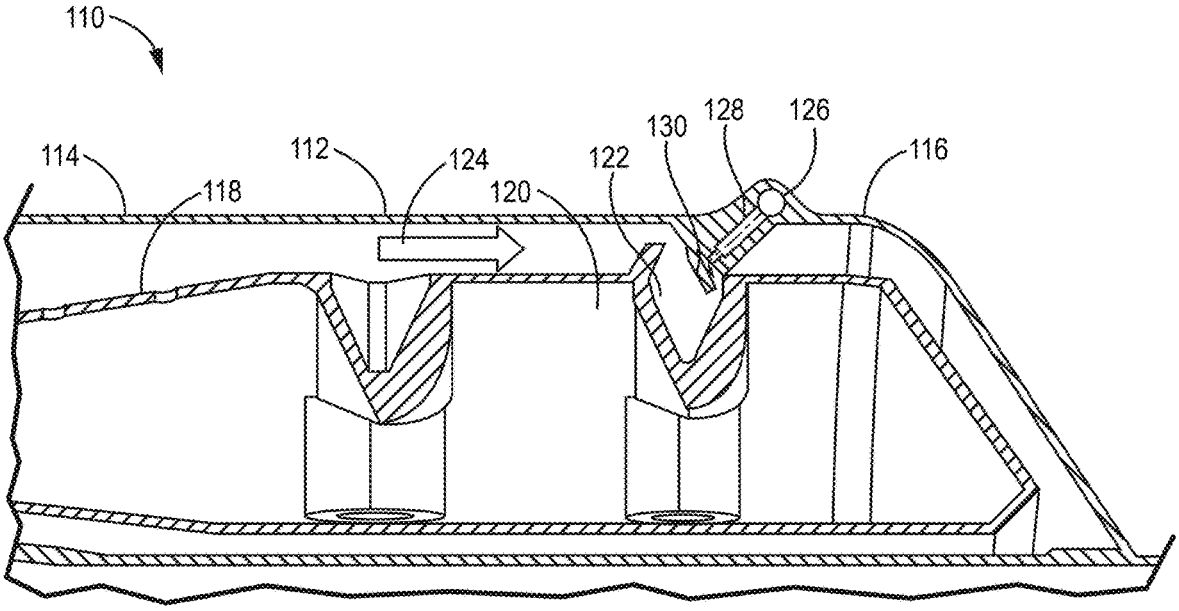
FIG. 1 (PRIOR ART)
FIG. 1 is a schematic side sectional illustration of a conventional combustor for an aerial vehicle.

FIG. 1 is a side sectional illustration of a conventional gas turbine engine combustor assembly 110 within an engine (not more broadly pictured). This engine can be located within an aerial vehicle such as, but not limited to, an unmanned aerial vehicle (UAV), a drone, or any other manned or unmanned aircraft or self-propelled projectile. This turbine engine is configured for propelling the aerial vehicle during flight.

Assembly 110 includes outer liner 112 with first end 114 and second end 116, inner combustor liner 118 defining central combustor chamber 120 with lumen 122, first air flow path 124, fuel manifold 126, fuel orifice 128, and splash plate 130.

In current combustor assemblies as shown in FIG. 1, outer liner 112 has first end 114 and second end 116. Outer liner 112 surrounds inner combustor liner 118. Inner combustor case defines central combustor chamber 120, with lumen 122 connecting inner combustor chamber 120 to first air flow path 124. Air flow path 124 is between outer liner 112 and inner combustor liner 118. Air flows from first end 114 of outer liner 112 towards second end 116 before being directed through into central combustor chamber 120 through lumen 122. Fuel manifold 126 is part of outer liner 112 and directs fuel from manifold 126 through fuel orifice 128 onto splash plate 130. Fuel mixes with air from air flow path 124 inside lumen 122 before entering central combustor chamber 120. In FIG. 1, air flows from first end 114 to second end before being directed into central combustor chamber 120, where flow direction flips from second end 116 to first end 114.

Figure 2:
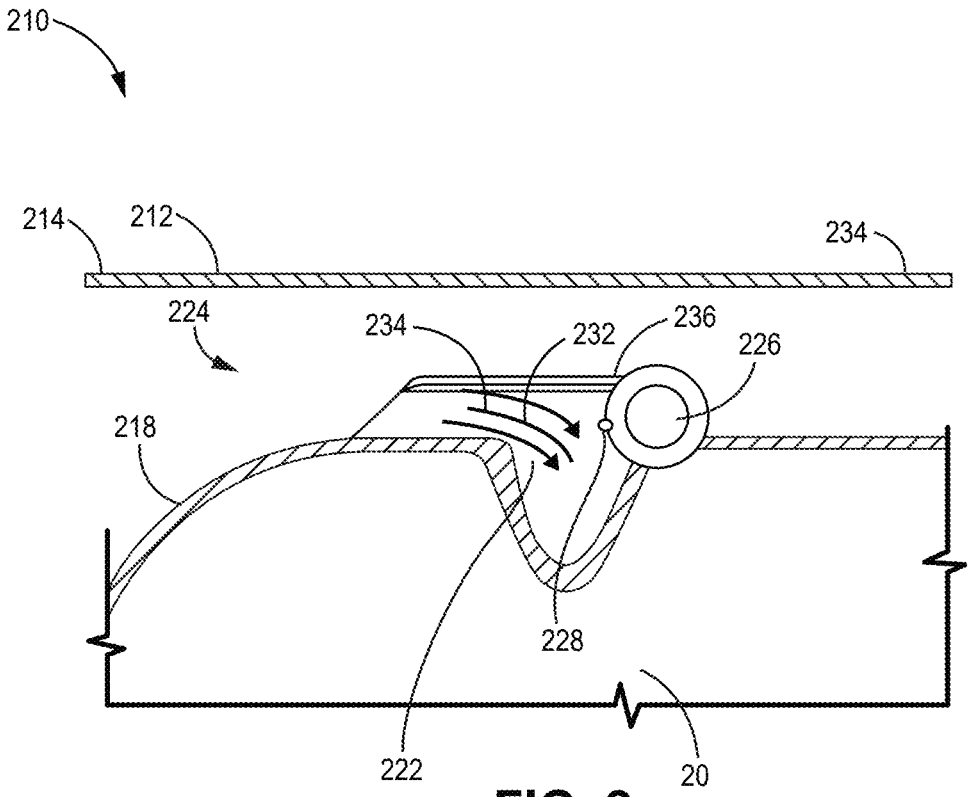
FIG. 2 is a cross-sectional view of a portion of a second embodiment of a combustor with an integrated scoop and fuel manifold, with a lattice splash plate.
Figure 3A:
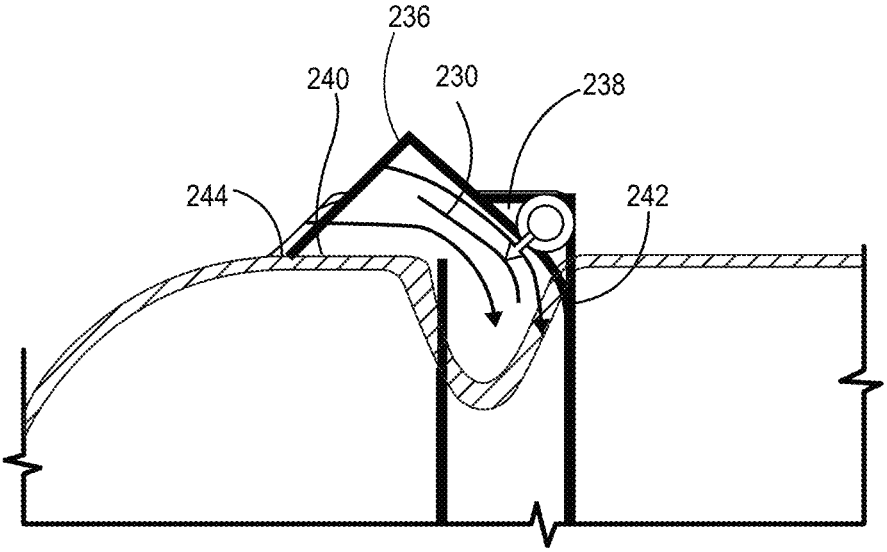
FIG. 3A is a cross-sectional view of a portion of a third embodiment of a combustor with a canted scoop and fuel manifold, with a lattice splash plate.
Figure 3B:
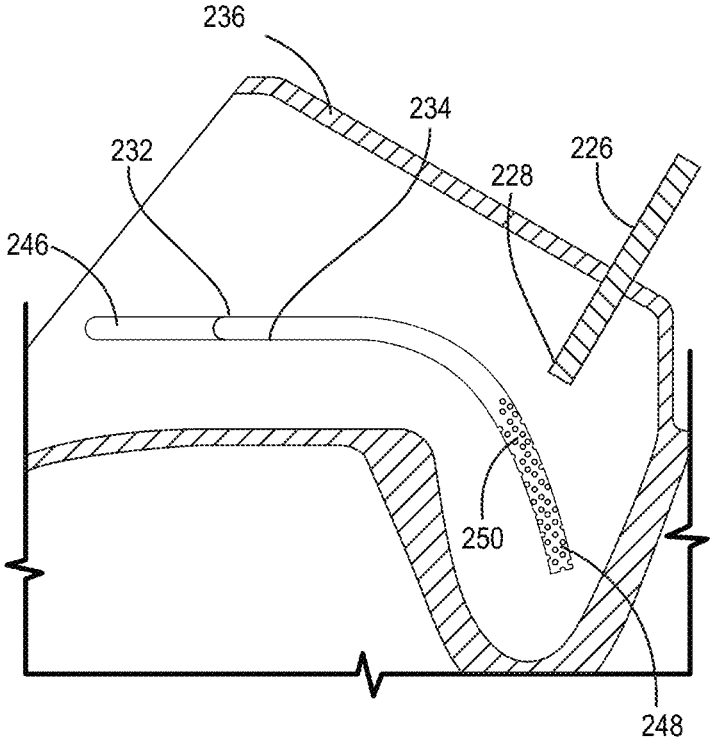
FIG. 3B is a cross-sectional view of a portion of the canted scoop and lattice splash plate.
Figure 4:
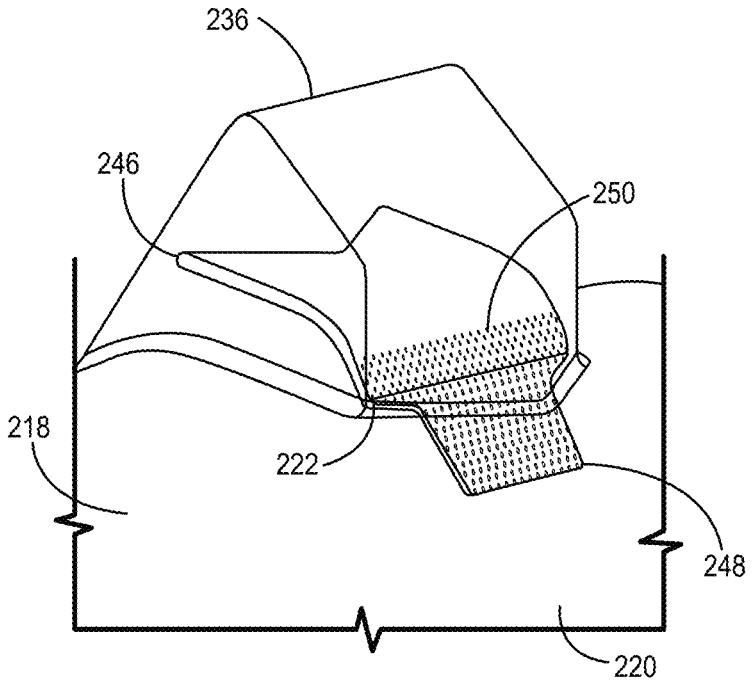
FIG. 4 is a schematic perspective view of a portion of the third embodiment of a combustor with a canted scoop and fuel manifold, with a lattice splash plate.

FIG. 2 is a cross-sectional view of a portion of a second embodiment of a combustor with an integrated scoop and fuel manifold, with a lattice splash plate. FIG. 3A is a cross-sectional view of a portion of the third embodiment of a combustor liner with a canted scoop and fuel manifold. FIG. 3B is a cross-sectional view of a portion of the third embodiment of a combustor with a canted scoop and lattice splash plate. FIG. 4 is a schematic cross-sectional view of a portion of the third embodiment with a canted scoop and lattice splash plate. FIGS. 2-4 will be discussed together.

FIGS. 2-4 show gas turbine engine combustor assembly 210, and illustrate many of the same functional elements in different arrangement and/or geometries.

Assembly 210 includes outer liner 212 with first end 214 and second end 216, inner combustor liner 218 defining central combustor chamber 220 with lumen 222, first air flow path 224 between outer liner 212 and inner combustor liner 218, fuel manifold 226, fuel orifice 228, and lattice splash plate 230 with first face 232 and second face 234. Assembly 210 further includes integrated air scoop 236 with first end 238 and second end 240. Lumen 222 further includes first lip 242 and second lip 244 (shown in FIG. 3A). Lattice splash plate 230 further includes first end 246, second end 248, and lattice holes 250 (best shown in FIG. 3B).

Air flow enters at first end 214 before flowing towards second end 216. Air flow can be a standard air mixture or have higher oxygen content. Inner combustor liner 218 defines central combustor chamber 220, with lumen 222 linking central combustor chamber 220 and air flow path 224. Integrated air scoop 236 directs air flow from air flow path 224 through lumen 222 into central combustor chamber 220. Due to fluid dynamics, as airflow enters first end 214, fluid flow will concentrate towards outer liner 212. Scoop 236 overcomes these fluidic forces to direct more airflow into central combustor chamber 220. Scoop 236 can be attached to inner combustor liner 218 at first lip 242 (shown in FIG. 3A). Fuel manifold 226 is integrated within scoop 236, and directs fuel through scoop 236 out of fuel orifice 228 onto splash plate 230. Splash plate 230 has first face 232 facing scoop 236, and second face 234 facing lumen 222 (faces 232, 234 shown in FIG. 2). Fuel orifice 228 can direct fuel perpendicular to first face 232 to provide a fuel film on splash plate 230 which is then mixed with the air and atomizes at the end of the splash plate. Splash plate 236 may be curved and start substantially parallel to flow path 224 before bending through lumen 222 and into central combustor chamber 220. Splash plate 236 as pictured in FIG. 2 also extends into air flow path 224 beyond first end 238 (shown in FIG. 3A) of scoop 236. By extending into air flow path 224, splash plate 236 helps to turn fluid flow from air flow path 224 into central combustor chamber 220. Fluid passes on both first face 232 of splash plate 236 where fuel from fuel orifice 228 mixes with fluid, and on second face 234 of splash plate. After fluid travels along the length of splash plate 230, unmixed fluid from second face 234 can mix with partially mixed fluid from first face 232 to result in stronger mixing before entering central combustor chamber 220.

In other embodiments (shown in FIGS. 3A and 3B) integrated air scoop 236 can be a canted scoop. Scoop 236 as pictured in FIG. 3A includes a first end 238 and second end 240. First end 238 attaches to inner combustor liner 218 at first lip 242, and second end 240 (shown in FIG. 3A) attaches at second lip 244. Scoop entrances 246 allows fluid to flow from flow path 224 into scoop 236 and over splash plate 230.

In these embodiments, the assembly as discussed above may be spaced circumferentially around an axis, with a plurality of scoops, lumens, and lattice splash plates into central combustor chamber.

Lattice splash plate 230 has a solid monolithic cross-sectional area near first end 214. As splash plate 230 curves into lumen 222, splash plate 230 begins to be graded into a lattice or mesh pattern with lattice holes 250 towards second end 248 of splash plate 230. The mesh/lattice splash 230 plate provides more surface area and promotes greater turbulence for fuel-air interaction which promotes greater atomization and mixing within the combustor. Depending upon configuration, this layout geometry also reduces engine weight. First end 246 functions to turn flow into lumen 222 before entering central combustion chamber 220. As fuel enters the system through fuel orifice 228, this turned air flow will mix with the fuel, and the mixing is aided by the lattice holes 250. As shown in FIG. 3B, fuel orifice 228 directs fuel flow on an area of splash plate 230 where lattice holes 250 have already begun. This also causes greater fuel atomization. The lattice density may be varied as a function of the distance from the first end 246 to the second end 248.

The proposed configurations as disclosed above will allow inner combustor liner 218 to slide from second end 216 of outer liner 212 to first end 214, while still allowing improved air flow into central combustor chamber 220. A small combustor is required to fit between different engine components, such as a centrifugal compressor and axial turbine (not pictured). Airflow on both sides of splash plate 230 help to shear the fuel off both first face 232 and second face 234 of splash plate 230, as lattice holes 250 facilitate fuel on both sides of splash plate 230. This configuration allows splash plate 230 to facilitate air/fuel mixing for a longer portion along splash plate 230, as well as on both faces of splash plate 230. In traditional designs, only first face 232 of any splash plate 230 facilitates air/fuel mixing from where fuel orifice 228 directs fuel onto splash plate until second end 248 of splash plate, where air from second face 234 of splash plate can then also mix with the air/fuel mixture. By including lattice holes 250, this mixing can be substantially longer, as well as causing fuel to atomize where fuel orifice 228 directs fuel onto the mesh/lattice surface of splash plate 230. There is very minimal impact on cost as the structure will not require additional mechanical post processing and is designed in the AM process envelope. This design reduces air pressure losses, improves fuel/air mixing, and feeds the combustor with bulk swirl for improved combustion efficiency with lower smoke. Additionally, this design allows additively manufactured components that have tighter clearances, resulting in higher efficiency. The geometries and features of the various embodiments illustrated in FIGS. 2-4 and discussed above can be mixed and/or combined in any functional manner.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

DISCUSSION OF POSSIBLE EMBODIMENTS

The following are non-exclusive descriptions of possible embodiments of the present invention.

In one embodiment, a combustor system for an aerial vehicle includes an outer liner with a first end and a second end, an inner combustor case within the outer liner, defining an outer periphery of a central combustor chamber, and having a lumen extending into the central combustor chamber. The system includes an air flow path extending between the outer liner and the inner combustor case, an integrated air scoop attached to the inner combustor case at the lumen which directs air from the air flow path into the central combustor chamber, a fuel manifold with a fuel orifice within the integrated air scoop, and a lattice splash plate with a first face, second face, first end, and a second end. The lattice splash plate extends through the first lumen into the central combustor chamber, and includes lattice holes which are graded into the lattice splash plate from the first end to the second end of the lattice splash plate.

The system of the preceding paragraph can optionally include, additionally and/or alternatively, any one or more of the following features, configurations and/or additional components:

The lattice splash plate can be connected to the integrated air scoop.

The lattice splash plate can be curved and configured to direct air flow into the central combustor chamber.

The lattice splash plate can extend from within the first air flow path, through the first lumen, and into the central combustor chamber.

The integrated air scoop can be canted and include a first end of the integrated air scoop connected to the inner combustor case on a first lip of the first lumen, and a second end of the integrated air scoop connected to the inner combustor case on a second lip of the first lumen.

The lattice splash plate can be parallel to the second end of the integrated air scoop.

The fuel orifice can be configured to direct fuel perpendicular to the second face of the lattice splash plate.

The fuel orifice can be configured to direct fuel perpendicular to the second face of the lattice splash plate.

The lattice splash plate can be spaced between a lip of the first lumen and an inner face of the integrated air scoop such that air from the first air flow path is split on the first face and the second face of the lattice splash plate.

The lattice splash plate can extend from within the first air flow path, through the first lumen, and into the central combustor chamber.

The fuel orifice can be located on an inner face of the integrated air scoop, and directs fuel perpendicular to and into lattice holes of the lattice splash plate.

The fuel orifice can be located on an inner face of the integrated air scoop.

The lattice splash plate can be connected to a support member, the support member connected to the integrated air scoop.

In another embodiment, a combustor system for an aerial vehicle includes an outer liner, the outer liner with a first end and a second end, an inner combustor case contained within the outer liner and defining an outer periphery of a central combustor chamber, lumens extending through the inner combustor case into the central combustor chamber, a first air flow path extending between and defined by the outer liner and the inner combustor case, and fluidly connected to the central combustor chamber by the lumens, integrated air scoops, each respective integrated air scoop attached to the inner combustor case at each respective lumen and configured to direct air from the first air flow path into the central combustor chamber, fuel manifolds with a fuel orifice within each respective integrated air scoop, and lattice splash plates comprising a first face and a second face, each respective splash plate extending through each respective lumen into the central combustor chamber, wherein lattice holes are graded into the respective lattice splash plate from the first end of the respective lattice splash plate to the second end of the respective lattice splash plate.

The system of the preceding paragraph can optionally include, additionally and/or alternatively, any one or more of the following features, configurations and/or additional components:

Each respective lattice splash plate can be connected to the respective integrated air scoop.

At least one lattice splash plate can be curved and configured to direct air flow into the central combustor chamber.

At least one lattice splash plate can extend from within the first air flow path, through the respective lumen, and into the central combustor chamber.

At least one integrated air scoop can be canted with a first end of the integrated air scoop connected to the inner combustor case on a first lip of the respective lumen, and a second end of the integrated air scoop connected to the inner combustor case on a second lip of the respective lumen.

Each respective lattice splash plate can be parallel to the second end of the integrated air scoop.

At least one fuel orifice can be configured to direct fuel perpendicular to the respective second face of the respective lattice splash plate.

The invention claimed is:

1. A combustor system for an aerial vehicle, the combustor system comprising:

an outer liner, the outer liner having a first end and a second end;

an inner combustor case contained within the outer liner, the inner combustor case defining an outer periphery of a central combustor chamber, the inner combustor case having a first lumen extending into the central combustor chamber;

a first air flow path extending between and defined by the outer liner and the inner combustor case;

an integrated air scoop attached to the inner combustor case at the first lumen and configured to direct air from the first air flow path into the central combustor chamber;

a fuel manifold with a fuel orifice within the integrated air scoop; and a lattice splash plate comprising a first face and a second face with a first end and a second end, the lattice splash plate extending through the first lumen into the central combustor chamber, wherein a plurality of lattice holes are graded into the lattice splash plate from the first end of the lattice splash plate to the second end of the lattice splash plate, wherein the lattice splash plate is curved and configured to direct air flow into the central combustor chamber, and wherein the lattice splash plate extends from within the first air flow path, through the first lumen, and into the central combustor chamber.

2. The combustor system of claim 1, wherein the lattice splash plate is connected to the integrated air scoop.

3. The combustor system of claim 1, wherein the integrated air scoop is canted and further comprises: a first end of the integrated air scoop connected to the inner combustor case on a first lip of the first lumen; and a second end of the integrated air scoop connected to the inner combustor case on a second lip of the first lumen.

4. The combustor system of claim 3, wherein the lattice splash plate is parallel to the second end of the integrated air scoop.

5. The combustor system of claim 4, wherein the fuel orifice is configured to direct fuel perpendicular to the second face of the lattice splash plate.

6. The combustor system of claim 1, wherein the fuel orifice is configured to direct fuel perpendicular to the second face of the lattice splash plate.

7. The combustor system of claim 1, wherein the lattice splash plate is spaced between a lip of the first lumen and an inner face of the integrated air scoop such that air from the first air flow path is split on the first face and the second face of the lattice splash plate.

8. The combustor system of claim 1, wherein the fuel orifice is located on an inner face of the integrated air scoop, and directs fuel perpendicular to and into the lattice holes of the lattice splash plate.

9. The combustor system of claim 1, wherein the fuel orifice is located on an inner face of the integrated air scoop.

10. The combustor system of claim 1, wherein the lattice splash plate is connected to a support member, the support member connected to the integrated air scoop.

11. A combustor system for an aerial vehicle, the combustor system comprising:

an outer liner, the outer liner having a first end and a second end;

an inner combustor case contained within the outer liner, the inner combustor case defining an outer periphery of a central combustor chamber, the inner combustor case having a plurality of lumens extending through the inner combustor case into the central combustor chamber;

a first air flow path extending between and defined by the outer liner and the inner combustor case, and fluidly connected to the central combustor chamber by the plurality of lumens;

a plurality of integrated air scoops, each respective integrated air scoop attached to the inner combustor case at each respective lumen and configured to direct air from the first air flow path into the central combustor chamber;

a plurality of fuel manifolds with a plurality of fuel orifices within each respective integrated air scoop; and a plurality of lattice splash plates comprising a first face and a second face, each respective splash plate extending through each respective lumen into the central combustor chamber, wherein a plurality of respective lattice holes are graded into the respective lattice splash plate from the first end of the respective lattice splash plate to the second end of the respective lattice splash plate, wherein at least one lattice splash plate of the plurality of lattice splash plates extends from within the first air flow path, through a respective lumen, and into the central combustor chamber.

12. The combustor system of claim 11, wherein each respective lattice splash plate is connected to the respective integrated air scoop.

13. The combustor system of claim 11, wherein at least one lattice splash plate of the plurality of lattice splash plates is curved and configured to direct air flow into the central combustor chamber.

14. The combustor system of claim 11, wherein at least one integrated air scoop of the plurality of integrated air scoops is canted with a first end of the integrated air scoop connected to the inner combustor case on a first lip of the respective lumen, and a second end of the integrated air scoop connected to the inner combustor case on a second lip of the respective lumen.

15. The combustor system of claim 14, wherein each respective lattice splash plate is parallel to the second end of the at least one integrated air scoop.

16. The combustor system of claim 15, wherein at least one fuel orifice of the plurality of fuel orifices is configured to direct fuel perpendicular to the respective second face of the respective lattice splash plate.

* * * * *